US007146816B2

(12) United States Patent
Anderson et al.

(10) Patent No.: US 7,146,816 B2
(45) Date of Patent: Dec. 12, 2006

(54) EFFUSION MOMENTUM CONTROL

(75) Inventors: Morris G. Anderson, Mesa, AZ (US); Hiroshi Kawamura, Glendale, AZ (US); Luis M. Flamand, Phoenix, AZ (US)

(73) Assignee: Honeywell International, Inc., Morristown, NJ (US)

( * ) Notice: Subject to any disclaimer, the term of this patent is extended or adjusted under 35 U.S.C. 154(b) by 107 days.

(21) Appl. No.: 10/919,663

(22) Filed: Aug. 16, 2004

(65) Prior Publication Data

US 2006/0032229 A1 Feb. 16, 2006

(51) Int. Cl.
*F02C 1/00* (2006.01)

(52) U.S. Cl. ..... 60/772; 60/754

(58) Field of Classification Search ..... 60/772, 60/752–760

See application file for complete search history.

(56) References Cited

U.S. PATENT DOCUMENTS 5,127,221 A 7/1992 Beebe
5,129,231 A 7/1992 Becker et al.
5,279,127 A 1/1994 Napoli
5,775,108 A 7/1998 Ansart et al.
5,918,467 A 7/1999 Kwan
5,956,955 A * 9/1999 Schmid ..... 60/748
6,145,319 A 11/2000 Burns et al.
6,408,629 B1 6/2002 Harris et al.
6,546,733 B1 * 4/2003 North et al. ..... 60/772
6,620,457 B1 9/2003 Farmer et al.
6,708,499 B1 3/2004 Pidcock et al.
6,868,675 B1 * 3/2005 Kuhn et al. ..... 60/772
6,955,053 B1 * 10/2005 Chen et al. ..... 60/804

* cited by examiner

*Primary Examiner*—William H. Rodriguez
(74) *Attorney, Agent, or Firm*—Ingrassia Fisher & Lorenz

(57) ABSTRACT

A combustor liner for shielding an engine from heat generated in a combustion zone includes a sheet with a cool surface for intercepting a cooling air stream and a hot surface enclosing the combustion zone, the combustor liner further including an array of effusion holes extending from the cool surface to the hot surface to allow a portion of the cooling air stream to pass through the effusion holes into the combustion zone, where a portion of the array includes a plurality of upstream-pointed effusion holes oriented such that each upstream-pointed effusion hole has an orientation obtuse to a direction of main flow in the combustion zone so as to control the momentum of cooling air passing into the combustion zone.

14 Claims, 7 Drawing Sheets

EFFUSION MOMENTUM CONTROL

GOVERNMENT RIGHTS

This invention was made with Government support under Contract No. DAAE07-02-3-0002 awarded by the United States Army. The Government has certain rights in this invention.

BACKGROUND OF THE INVENTION

The present invention generally relates to gas turbine engines, and in particular to a device and method for cooling an engine combustor liner.

Gas turbine engines typically include a compressor for supplying pressurized air to a combustion zone in which the pressurized air is mixed with fuel and burned to generate hot combustion gases for powering the turbine. A combustor liner, which may be formed from a metallic sheet, is typically provided to protect surrounding engine structure from the high-temperature combustion gases. Combustor liners are cooled to increase the life of the liner.

Some cooling of the combustor liner may be accomplished by directing a portion of the compressor air to flow over an exterior, or "cold," surface of the combustor liner and remove heat by convection. A conventional combustor liner may include an array of very small openings, referred to as effusion holes, which allow a portion of the cooling air to enter the combustor liner and to also remove heat by convection.

A conventional turbine engine assembly 10, partially shown in the cross-sectional view of FIG. 1, may include a compressor 11, a combustor 13, and a fuel nozzle 15 extending into a combustion zone 17 located within the combustor 13. The combustion zone 17 may be partially enclosed by a combustor liner 20 which functions to reduce the amount of heat emanating from the combustion zone 17 onto casing surfaces of the engine assembly 10. The combustor liner 20 may comprise one or more non-planar sheets of metal or other heat-resistant material. In the configuration shown, the combustor liner 20, which may be generally toroidal in shape, comprises a contoured (i.e., nonplanar) outer liner 21, a contoured inner liner 23, and a liner dome 25. It should be understood that the outer liner 21 and the inner liner 23 can be, for example, cylindrical or conical in shape.

The compressor 11 may supply a cooling air stream 31 which is incident upon the combustor liner 20. A first portion of the cooling air stream 31 may pass through effusion holes (not shown) in the liner dome 25 and enter the combustion zone 17 as a liner dome air stream 33. Additionally, a second portion of the cooling air stream 31 may pass through effusion holes (not shown) in the outer liner 21 and enter the combustion zone 17 as an outer liner air stream 35. Similarly, a third portion of the cooling air stream 31 may pass through effusion holes (not shown) in the inner liner 23 and enter the combustion zone 17 as an inner liner air stream 37.

The liner dome air stream 33, the outer liner air stream 35, and the inner liner air stream 37 may be utilized in the combustion of fuel in the combustion zone 17 and subsequently flow out of the combustion zone 17 as an exhaust gas stream 39. Additional air may be supplied to the combustion zone 17 through a plurality of primary holes and dilution holes (not shown for clarity of illustration), as known in the art, on both the outer liner and the inner liner 23. This additional air is primarily utilized in the combustion process and is not considered part of the process for cooling the combustor liner 20. It can be appreciated by one skilled in the art that the combustor liner 20 may be shaped so as to aid in producing an effective mixing of fuel and air within the combustion zone 17 for efficient combustion.

Referring to FIG. 2, also of the prior art, a portion of the liner dome 25 may have an array of downstream-pointed effusion holes 41 therethrough. The liner dome 25 may include an exterior cold dome surface 27 which is positioned in the cooling air stream 31 and an interior hot dome surface 29 which partially encloses the ongoing exothermic reaction in the combustion zone 17.

In the particular configuration shown, the plurality of downstream-pointed effusion holes 41 may form a series of adjacent rows, such as rows 43*a–e*, each downstream-pointed effusion hole 41 having a longitudinal axis 47 which may be generally aligned with the direction of the main flow of gases in the combustion zone 17, the direction indicated by arrow 19, proximate the hot dome surface 29. That is, the particular geometry of the downstream-pointed effusion holes 41, as well as the location and number of rows 43*a–e*, may be determined from thermodynamic aspects of the dynamic flow of air and fuel in the combustion zone 17. As the liner dome air stream 33 (not shown in FIG. 2 for clarity) passes through the array of downstream-pointed effusion holes 41, cooling air flows along the hot dome surface 29.

FIG. 3 is an enlarged detail view of the hot surface 29, also according to the prior art, showing four of the downstream-pointed effusion holes 41 located in the adjacent rows 43*a* and 43*b* of the liner dome 25. Each longitudinal axis 47 may be oriented generally with the direction of the main flow, indicated by arrow 19. As the cooling air stream 31 impinges on the cold dome surface 27 of the liner dome 25, a portion of the cooling air stream 31 may pass through the plurality of downstream-pointed effusion holes 41 in the direction of the respective longitudinal axes 47 and enter the combustion zone 17 as the liner dome air stream 33. After passing through the downstream-pointed effusion holes 47, the liner dome air stream 33 mixes with and becomes part of the main flow. This is a consequence of the orientation of the downstream-pointed effusion holes 41 with the direction of the main flow in the combustion zone 17. It can thus be appreciated that the liner dome air stream 33 may generally have such a large velocity or momentum when leaving the downstream-pointed effusion holes 41 that the fluid dynamic characteristics of the main flow are affected by the liner dome air stream 33 proximate the hot dome surface 29.

As taught in the present state of the art, effusion holes may be oriented such that the entering cooling air is directed along the "main flow," that is, along the local prevailing flow of hot gases in the combustion zone. For example, U.S. Pat. No. 5,129,231 issued to Becker et al. discloses a heat shield for fuel nozzles mounted at the dome of an annular combustor for a gas turbine engine, in which the effusion holes are oriented to inject the cooling air so as to be compatible with the direction of swirling air in the combustion zone.

U.S. Pat. No. 5,918,467 issued to Kwan discloses a heat shield for a gas turbine annular combustion zone in which an array of effusion holes in the heat shield is subdivided into sectors. Within each sector, the effusion holes are arranged parallel to one another and extend in the direction of the enclosed fuel consumption air swirl. U.S. Pat. No. 6,408,629 issued to Harris et al. discloses a multi-hole combustor liner in which the orientation of a select group of effusion holes is generally in the direction of the main flow, but may be altered to direct cooling air to "hot spot" regions, such as regions downstream of dilution holes. The problem remains that, because the orientation of the effusion holes is in the direction of the main flow, as taught both in Kwan '467 and in Harris et al. '629, the cooling air is introduced into the combustion zone at a speed sufficient to affect the main flow, the cooling air entrains hot gases from the combustion zone and is thus less effective at removing heat from the hot surface of the combustor liner, resulting in higher combustor liner temperatures.

As can be seen, there continues to be a need for a method and apparatus for controlling the cooling air flowing into a combustor liner.

SUMMARY OF THE INVENTION

In one aspect of the present invention, a combustor liner comprises a sheet having a cool surface for intercepting a cooling air stream and a hot surface enclosing a combustion zone, the sheet further having an array of effusion holes therethrough wherein a local region of the array of effusion holes includes a plurality of downstream-pointed effusion holes and a plurality of upstream-pointed effusion-pointed holes, the plurality of downstream-pointed effusion holes oriented such that each downstream-pointed effusion hole has a longitudinal axis oriented in the direction of a main flow in the combustion zone, and each upstream-pointed effusion hole has an orientation obtuse to the main flow direction.

In another aspect of the present invention, a combustor liner includes a nonplanar inner liner; a nonplanar outer liner; and a liner dome attached to the inner liner and to the outer liner so as to form an assembly enclosing a combustion zone, the liner dome having a exterior cool surface for intercepting a cooling air stream and an interior hot surface, the liner dome further having an array of effusion holes therethrough, each effusion hole extending from the cool surface to the hot surface such that a portion of the cooling air stream passes through the plurality of effusion holes into the combustion zone, wherein a local region of the array of effusion holes includes a plurality of downstream-pointed effusion holes and a plurality of upstream-pointed effusion holes, the plurality of downstream-pointed effusion holes oriented such that each downstream-pointed effusion hole has a longitudinal axis oriented in the direction of the main flow in the combustion zone, and each upstream-pointed effusion hole has an orientation obtuse to the main flow direction of gases in the combustion zone.

In yet another aspect of the present invention, a turbine engine comprises a combustor liner enclosing a combustion zone, the combustor liner having at least one exterior cool surface for intercepting a cooling air stream and at least one interior hot surface, the combustor liner further having an array of effusion holes therethrough, wherein a local region of the array of effusion holes includes a plurality of downstream-pointed effusion holes and a plurality of upstream-pointed effusion holes, the plurality of downstream-pointed effusion holes being oriented such that each downstream-pointed effusion hole has a longitudinal axis oriented in the direction of the main flow in the combustion zone, and each upstream-pointed effusion hole has an orientation obtuse to the direction of the main flow.

In still another aspect of the present invention, combustor liner comprises a liner dome having a cool surface for intercepting a cooling air stream and a hot surface for partially enclosing a combustion zone, the liner dome further having an array of dome effusion holes, each of the dome effusion holes extending from the cool surface to the hot surface so as to allow a portion of the cooling air stream to pass through the plurality of dome effusion holes into the combustion zone, wherein a local region of the array of dome effusion holes including a plurality of downstream-pointed dome effusion holes and a plurality of upstream-pointed dome effusion holes, the plurality of downstream-pointed dome effusion holes oriented such that each downstream-pointed dome effusion hole has a longitudinal axis generally in the direction of a main flow in the combustion zone, and each upstream-pointed dome effusion hole has a longitudinal axis forming an obtuse angle with the direction of the main flow such that cooling air entering the combustion zone through the upstream-pointed dome effusion holes reduces the momentum of cooling air entering the combustion zone through the downstream-pointed dome effusion holes; a nonplanar inner liner partially enclosing the combustion zone and attached to the liner dome, the inner liner having a plurality of inner liner downstream-pointed effusion holes and a plurality of inner liner upstream-pointed effusion holes; and a nonplanar outer liner partially enclosing the combustion zone and attached to the liner dome, the outer liner having a plurality of outer liner downstream-pointed effusion holes and a plurality of outer liner upstream-pointed effusion holes.

In a further aspect of the present invention, a method of controlling the flow of air through combustor liner effusion holes to increase cooling efficiency comprises changing the orientation of a local region of the combustor liner effusion holes from an orientation where each effusion hole in the portion has a longitudinal axis oriented in the main flow direction in an enclosed combustion zone to an orientation where each effusion hole in the portion has the longitudinal axis oriented at an obtuse angle to the main flow direction; and selecting a value for the obtuse angle from a range of 90° to 180°.

In yet a further aspect of the present invention, a method of making a combustor liner for increasing cooling efficiency, the combustor liner having an initial array of effusion holes, comprising: selecting a local region of the initial array of effusion holes for analysis; denoting a fraction of the effusion holes in the local region as upstream-pointed effusion holes so as to provide a revised effusion hole configuration; specifying an obtuse orientation angle for each of the upstream-pointed effusion holes in the revised effusion hole configuration such that the upstream-pointed effusion holes are oriented at the obtuse orientation angle to a main flow direction in the combustor liner; analyzing the resulting array to produce temperature distribution data quantifying cooling efficiency at an interior surface of the combustor liner; and if the temperature distribution data are not within a desired range, repeating the steps of denoting a fraction, specifying an obtuse orientation angle, and analyzing the resulting array to obtain a satisfactory effusion hole configuration.

In a still further aspect of the present invention, a method for controlling the momentum of effusion flow in a gas turbine engine combustion zone comprises providing a combustor liner component having an array of effusion holes; and passing an airflow through the effusion holes to provide cooling of an interior hot surface of the combustor liner component, the array of effusion holes comprising a plurality of upstream-pointed effusion holes and a plurality of downstream-pointed effusion holes, wherein each downstream-pointed effusion hole has a longitudinal axis generally aligned with a main flow direction in the combustion zone, and each upstream-pointed effusion hole has a longitudinal axis generally oriented at an obtuse angle to the main flow direction.

In yet another aspect of the present invention, a method for cooling a combustor liner component of a gas turbine engine comprises providing a cooling air stream against the combustor liner component, the combustor liner component having an array of effusion holes; and passing air from the cooling airstream through each of the effusion holes, wherein the array of effusion holes comprises a plurality of upstream-pointed effusion holes and a plurality of downstream-pointed effusion holes, wherein each downstream-pointed effusion hole has a longitudinal axis generally aligned with a main flow direction in the gas turbine engine, and each upstream-pointed effusion hole has a longitudinal axis generally oriented at an obtuse angle to the main flow direction.

These and other features, aspects, and advantages of the present invention will become better understood with reference to the following drawings, description and claims.

DETAILED DESCRIPTION OF THE INVENTION

The following detailed description is of the best currently contemplated modes of carrying out the invention. The description is not to be taken in a limiting sense, but is made merely for the purpose of illustrating the general principles of the invention, since the scope of the invention is best defined by the appended claims.

The present invention generally provides a method and apparatus for improving cooling efficiency of a combustor liner, e.g., of a gas turbine engine, by controlling the momentum (i.e., the speed and the direction) at which cooling air enters a combustion zone through the combustion liner. In comparison, conventional combustor liners may disclose means for altering the direction of cooling air flow in the combustion zone, but do not disclose means for controlling the speed of entry of the cooling air flow through the combustor liner into the combustion zone.

A conventional combustor liner includes an array of downstream-pointed effusion holes oriented with the direction of the main flow in the combustor. In the present invention, the combustor liner includes upstream-pointed effusion holes as well as downstream-pointed effusion holes in an effusion hole array, where the upstream-pointed effusion holes are oriented in a direction generally opposite to that of the main flow. The upstream-pointed effusion holes function to provide cooling air flow which interacts with the cooling air flow provided via the downstream-pointed effusion holes. The interaction results in a local turbulence at the hot surface of the combustion liner. This turbulence serves to decrease the momentum with which cooling air enters the combustion zone and thus provides at least two advantages over the present state of the art. First, the cooling air entering the combustor produces less of an impact on the main flow and, second, the cooling air is less likely to entrain hot gases from the combustion zone and thus tends to remain at the hot surface to remove heat via conduction and provide for a greater cooling efficiency.

Figure 4:
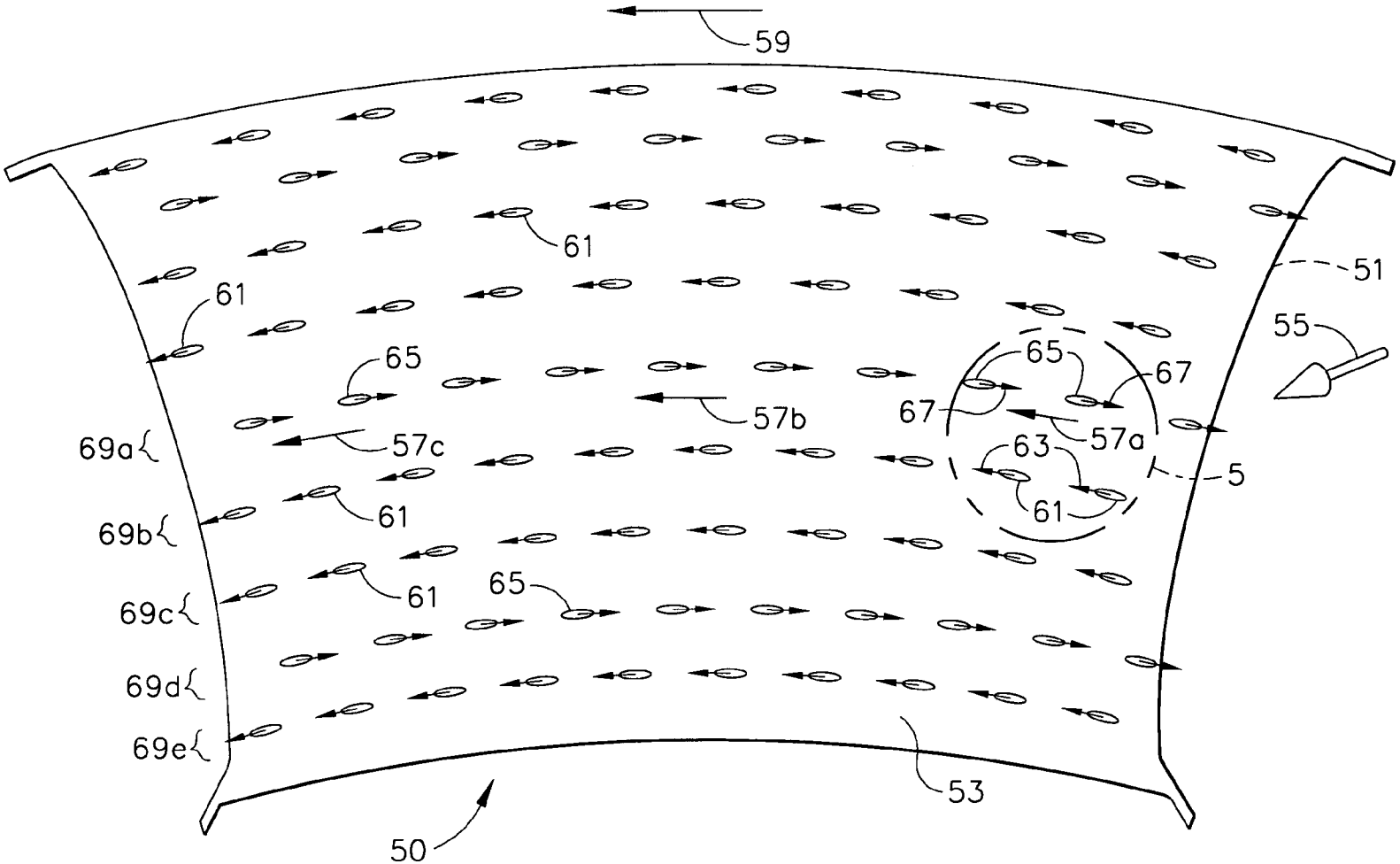
FIG. 4 is a sectional view of a combustor liner, in accordance with the present invention, showing an interior surface of a combustor liner dome having a plurality of upstream-pointed effusion holes oriented opposite to the direction of a main flow.

FIG. 4 shows a portion of a liner dome 50 having an array of effusion holes comprising a plurality of downstream-pointed dome effusion holes 61 and a plurality of upstream-pointed dome effusion holes 65 therethrough, in accordance with the present invention. The effusion holes 61 and 65 may be approximately 0.015 to 0.030 inch in diameter, and the array may comprise a surface density of approximately forty (40) to fifty (50) effusion holes per square inch of the liner dome 50. The liner dome 50 may include an exterior cold dome surface 51 which is positioned to intercept a cooling air stream 55, and an interior hot dome surface 53 which partially encloses the exothermic reaction within the combustion zone 17. The plurality of downstream-pointed effusion holes 61 and upstream-pointed effusion holes 65 may be arranged, as an example, in a repeating series of rows such as a first row 69*a* of upstream-pointed dome effusion holes 65, a second row 69*b* of downstream-pointed effusion holes 61, a third row 69*c* of downstream-pointed effusion holes 61, a fourth row 69*d* of upstream-pointed effusion holes 65, and a fifth row 69*e* of downstream-pointed effusion holes 61.

Each downstream-pointed effusion hole 61 in the rows 69*b*, 69*c*, and 69*e* has a longitudinal axis 63, where the longitudinal axes 63 may be generally parallel to one another and may also be oriented in the direction of the main flow, indicated by arrow 59, so as to produce a liner dome air stream, indicated for example by arrows 57*a*, 57*b*, and 57*c*, flowing generally in the direction of the main flow. The orientation of longitudinal axes 67 of the upstream-pointed effusion holes 65 in the rows 69*a* and 69*d*, may be in a direction at least generally opposite to the direction of the longitudinal axes 63 of the downstream-pointed effusion holes 61, and consequently opposite in direction to the direction of the main flow 59, as explained in greater detail below.

Advantageously, such a configuration serves to control the surface velocity of the liner dome air stream, such as indicated by arrows 57*a*, 57*b*, and 57*c*, leaving the downstream-pointed effusion holes 61 and flowing over the hot dome surface 53. When the surface velocity of the liner dome air stream 33 is thus controlled, preferably resulting in a cooling airflow with decreased momentum, the liner dome air stream 33 may be less likely to entrain hot gas from the combustion zone 17. Consequently, the liner dome air stream 33 may flow away from the hot dome surface 53 at a slower speed, and may thus increase the amount of heat transferred from the hot dome surface 53 to the liner dome air stream 33, and in addition, may provide an insulating layer of relatively cool air at the hot dome surface 53. With an improvement in heat transfer in accordance with the present invention, less of the airflow from the compressor 11 may be needed for providing adequate cooling air to the combustor liner 20 and can be diverted for use in other areas of the turbine engine assembly 10.

Figure 5:
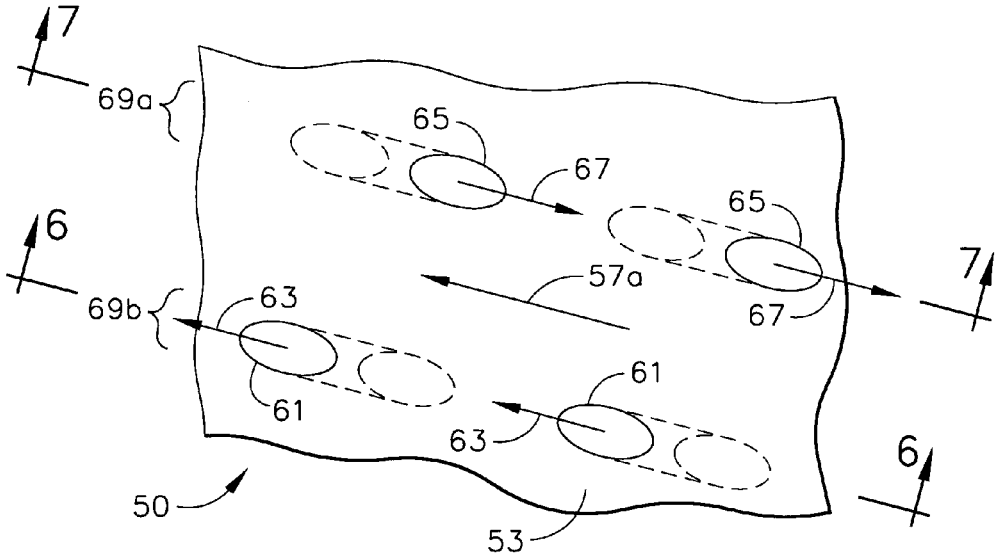
FIG. 5 is an enlarged detail view of a local region of the interior surface of the combustor liner dome of FIG. 4, in accordance with the present invention, showing a portion of an array of downstream-pointed and upstream-pointed effusion holes.

FIG. 5 is a detail view of a local region of the liner dome 50 of FIG. 4, showing two upstream-pointed effusion holes 65 located in the row 69*a* and two downstream-pointed effusion holes 61 located in the row 69*b*. As used herein, "local region" means a relatively small area of the hot surface 53 in which the longitudinal axes 63 of the downstream-pointed effusion holes 61 are generally parallel to one another. The effusion holes may be formed in the combustor liner 50 at an angle, typically about 20° out of the plane of the metallic sheet, as described below.

Figure 6:
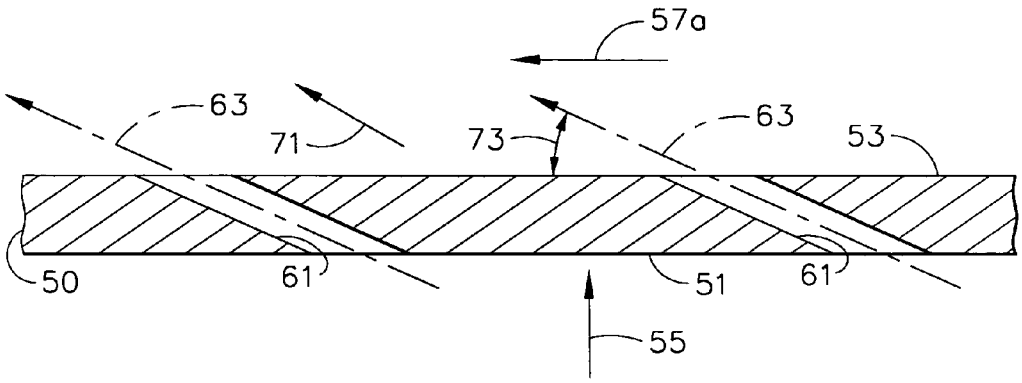
FIG. 6 is a sectional view of two downstream-pointed effusion holes taken along the lines 6—6 of FIG. 5, in accordance with the present invention.
Figure 7:
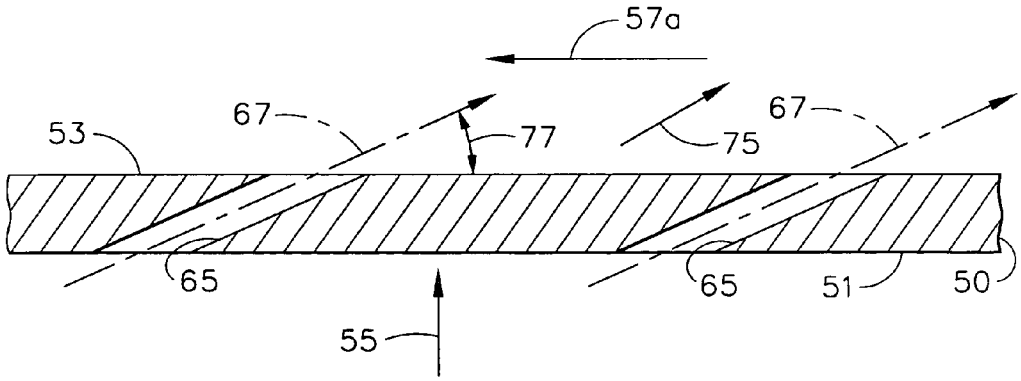
FIG. 7 is a sectional view of two upstream-pointed effusion holes, taken along the lines 7—7 of FIG. 5, in accordance with the present invention.

FIG. 6 is a cross-sectional view of the two downstream-pointed effusion holes 61 located in the row 69*b* of FIG. 5. The longitudinal axes 63 of the downstream-pointed effusion holes 61 in the row 69*b* may be inclined at an acute angle 73 to the hot dome surface 53. The acute angle 73 may be in the range of 15° to 30°. FIG. 7 is a cross-sectional view of the two upstream-pointed effusion holes 65 located in the row 69*a* of FIG. 5. The longitudinal axes 67 of the upstream-pointed effusion holes 65 may be inclined at an acute angle 77 to the hot dome surface 53. The acute angle 77 may be in the range of 15° to 25°. Thus, the longitudinal axes 67 of the upstream-pointed effusion holes 65 are generally anti-parallel to the longitudinal axes 63 of the downstream-pointed effusion holes 61. That is, whereas the projections of the longitudinal axes 63 onto the hot dome surface 52 are oriented in the direction of the main flow in the local region, the projection of the proximate longitudinal axes 67 onto the hot dome surface 52 form approximately 180° angles with the direction of the main flow in the local region.

As the cooling air stream 55 impinges on the cold dome surface 51 of the liner dome 50, a first portion of the cooling air stream 55 may pass through the plurality of downstream-pointed effusion holes 61 in the direction of the respective longitudinal axes 63 as a liner dome downstream air flow 71, shown in FIG. 6. A second portion of the cooling air stream 55 may pass through the plurality of upstream-pointed effusion holes 65 in the row 69*a* in the direction of the respective longitudinal axes 67 as a liner dome upstream-pointed air flow 75, shown in FIG. 7.

Figure 2:
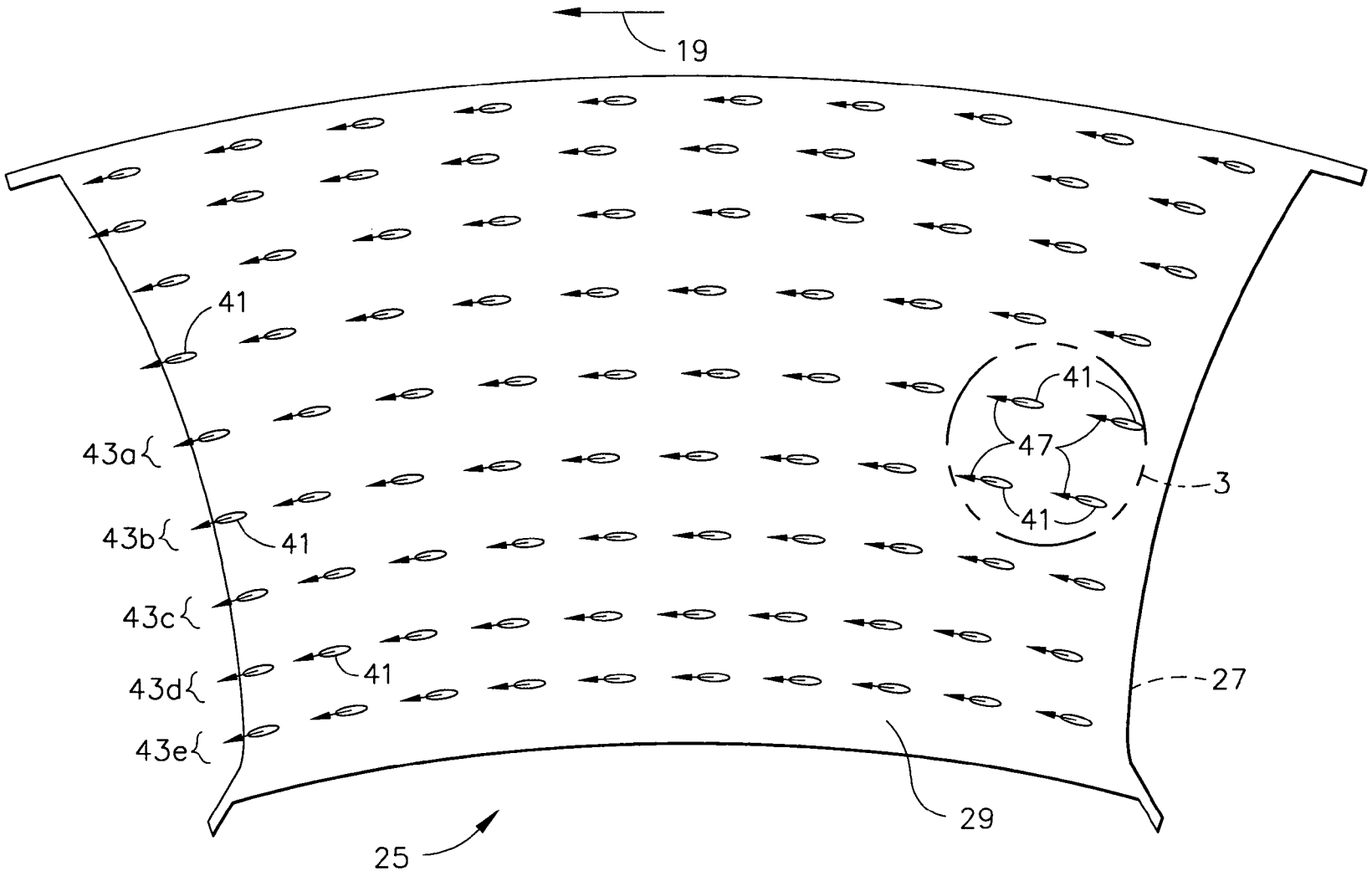
FIG. 2 (PRIOR ART)
FIG. 2 is a sectional view taken along the line 2—2 of the combustor liner of FIG. 1 showing an interior surface of a combustor liner dome.
Figure 3:
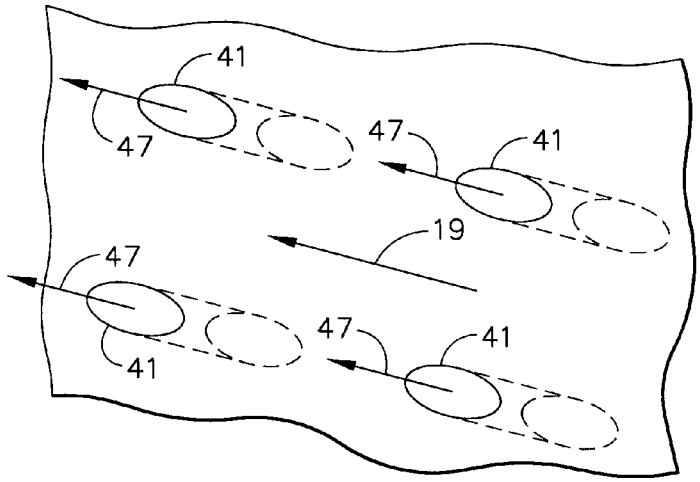
FIG. 3 (PRIOR ART)
FIG. 3 is an enlarged detail view of a portion of the interior surface of the combustor liner dome of FIG. 2 showing a conventional array of downstream-pointed effusion holes.

Because the upstream-pointed effusion holes 65 point in a direction counter to the main flow in the vicinity of the hot dome surface 52, cooling air from the liner dome upstream air flow 75 functions to oppose cooling air from the liner dome downstream air flow 71. Accordingly, the resulting speed of entry (and momentum) of the liner dome air stream 57*a* may be less than the speed of entry of the liner dome air stream 33 in the prior-art configuration of FIG. 2. Accordingly, the configuration of FIG. 4 may function to control the momentum of cooling gas entering from the downstream-pointed dome effusion holes 61 via the upstream-pointed dome effusion holes 65, and thus to minimize disturbance to the combustion gases in the combustion zone 17.

Figure 8:
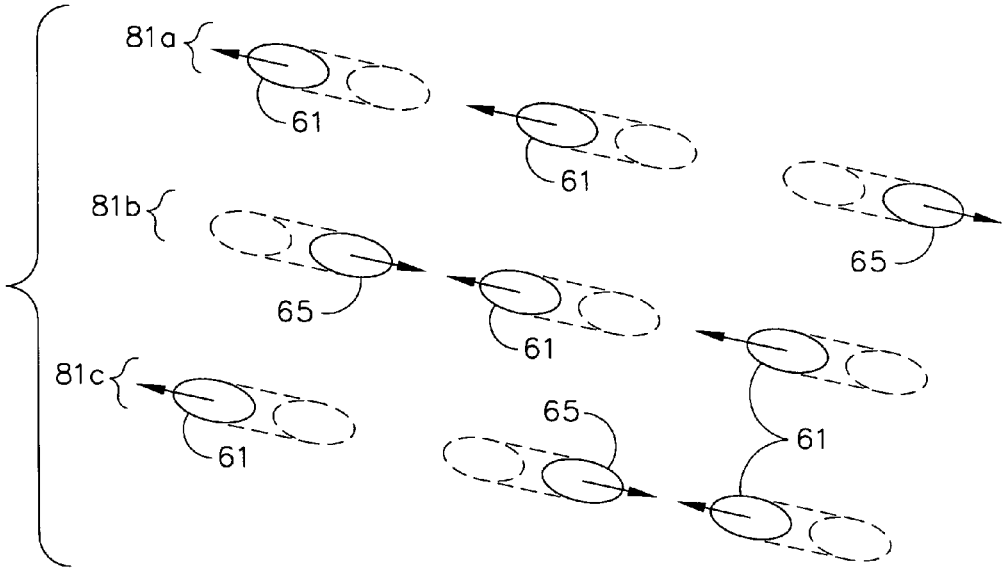
FIG. 8 is a detail view of another embodiment of an effusion hole array having upstream-pointed effusion holes oriented opposite to the direction of the main flow and disposed among a plurality of downstream-pointed effusion holes, according to the present invention.
Figure 10:
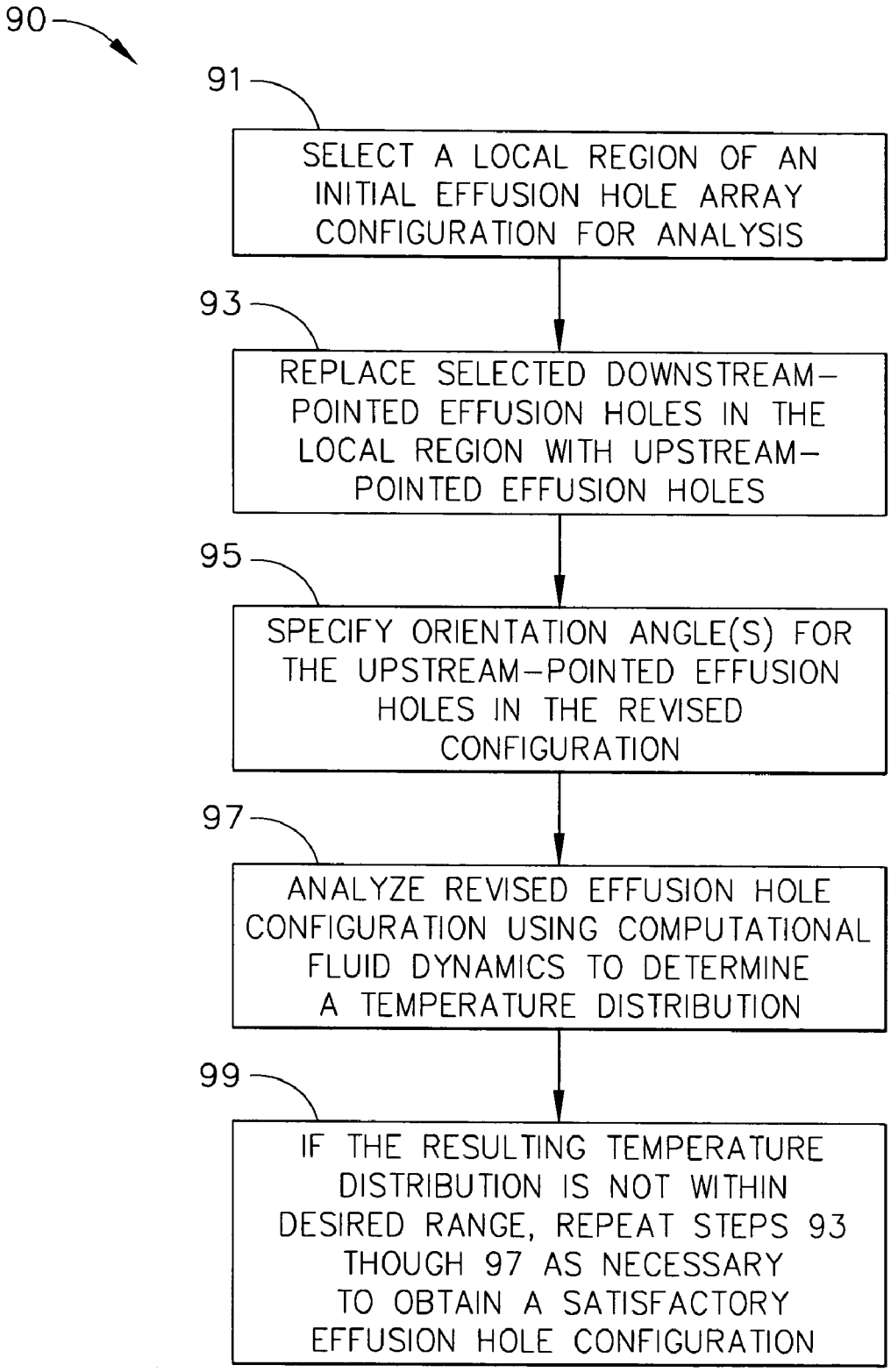
FIG. 10 is a flow diagram illustrating an iterative process of making a combustor liner in accordance with the present invention.

In another embodiment of the present invention, a pre-determined portion of effusion holes in an effusion hole array may be oriented in a direction opposite to that of the direction of the other effusion holes in the array, where the pre-determined portion of diffusion holes may be distributed among or within rows of the effusion hole array. For example, in the partial detail view of FIG. 8, a local region of effusion holes may include a plurality of downstream-pointed effusion holes 61 oriented in the direction of the main flow, and a pre-determined portion of upstream-pointed effusion holes 65 oriented in a direction opposite to that of the main flow. It can be appreciated by one skilled in the relevant art that the fraction of effusion holes in the effusion hole array which comprises the 'pre-determined portion' can be derived by means of an analytical process such as the design procedure described below, in the flow diagram of FIG. 10.

The upstream-pointed effusion holes 65 may comprise one third of the effusion hole array, for example, and the downstream-pointed effusion holes 61 may comprise the remaining two thirds of the effusion hole array. For example, every third effusion hole in rows 81*a–c* may comprise an upstream-pointed effusion hole 65 with the remaining effusion holes comprising downstream-pointed effusion holes 61, generally staggered as shown. It should be understood that the present invention is not limited to a distribution ratio of one third upstream-pointed effusion holes and two thirds downstream-pointed effusion holes, however, and may comprise, as an example, a distribution ratio of from one tenth to one half. In general, the fraction of upstream-pointed dome effusion holes 65 in a local region of the effusion hole array may be specified as $0<\text{fraction}\leqq 100\%$, that is at least one to all of the effusion holes in a selected local region are upstream-pointed effusion holes. In addition, the present invention is not limited to a staggered or a row-by-row distribution of upstream-pointed effusion holes 65 within an array of downstream-pointed effusion holes 61, and other distribution geometries can be used.

Figure 9:
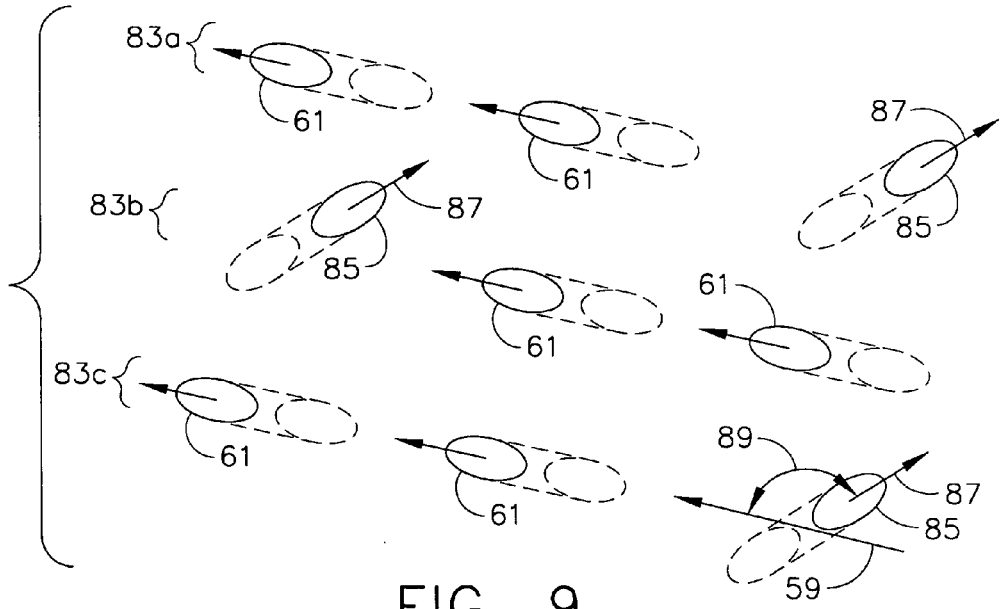
FIG. 9 is a detail view of yet another embodiment of an effusion hole array having upstream-pointed effusion holes oriented at obtuse angles to the main flow direction, in accordance with the present invention.

In yet another embodiment of the present invention, shown in the partial detail view of FIG. 9, a pre-determined portion of upstream-pointed effusion holes 85 in an array of effusion holes may each be oriented such that the respective longitudinal axes 87 are generally obtuse to the direction of the main flow, the direction indicated by arrow 59. For example, a local region of effusion holes may include a series of rows 83*a–c* comprising both downstream-pointed effusion holes 61 and upstream-pointed effusion holes 85. The longitudinal axis 87 of each upstream-pointed effusion hole 85 may be oriented at an obtuse angle 89 to the direction of the main flow, as shown, where the obtuse angle 89 may be quantified by the expression: $90°\leqq\text{obtuse angle}\leqq 180°$.

It should be understood that as the illustration of FIG. 9 is a planar view of a portion of the hot dome surface 52, the obtuse angle 89 may be determined by measuring the angle between the direction of the main flow (i.e., as indicated by arrow 59) and the projection of the longitudinal axis 87 onto the hot dome surface 52. In another alternative embodiment (not shown), the longitudinal axes 87 of the upstream-pointed effusion holes 85 may be oriented at two or more different orientation angles, each orientation angle lying in the range of from 90° to 180°.

By specifying the fraction of and orientation angle(s) for upstream-pointed effusion holes in the local region of an effusion hole array, the momentum at which a liner dome air stream 79 enters the combustion zone 17 can be controlled to produce more efficient cooling and lower temperatures on the hot dome surface 52 than can be achieved with a conventional array of effusion holes comprising only downstream-pointed effusion holes 41. Such a design procedure may perform an analytical design of experiments by utilizing a computer model of the combustor liner including an initial array of downstream-pointed dome effusion holes 61 and upstream-pointed dome effusion holes 65 and/or upstream-pointed effusion holes 85, and may follow the steps presented in a flow diagram 90, shown in FIG. 10.

Using the computer model of the combustor liner, a local region of the initial array for analysis may be selected in step 91. A fraction of the effusion holes 61 in the selected local region of the array may be denoted as comprising upstream-pointed effusion holes 65 and/or upstream-pointed effusion holes 85 at step 93, where 0<fraction≦100%. An orientation angle for each of the upstream-pointed effusion holes 65 and 85 in the revised configuration of the local region of the array may be specified at step 95, where 90°≦orientation angle≦180°. Using Computational Fluid Dynamics (CFD), the revised configuration may be analyzed to produce temperature distribution data, at step 97. If the resulting temperature distribution data are not within a desired range, indicating an unacceptable temperature distribution, at step 99, steps 93 through 97 may be repeated iteratively, as necessary to improve the computed temperature distribution. If the resulting temperature distribution data are within the desired range, the resulting configuration of upstream-pointed and downstream-pointed effusion holes can be used in the fabrication of the liner dome 50.

Figure 1:
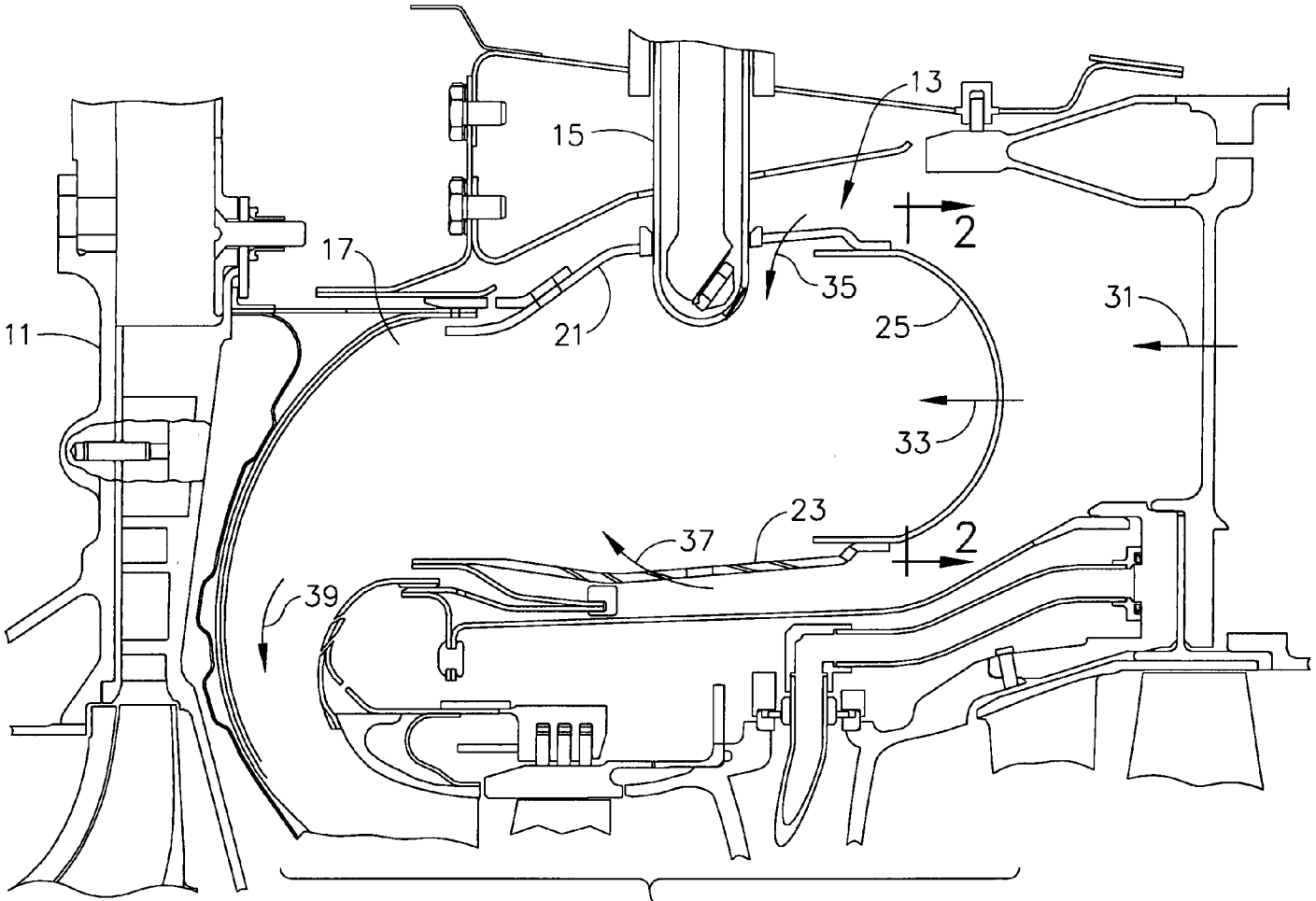
FIG. 1 (PRIOR ART)
FIG. 1 is a cross-sectional view of a conventional turbine engine with a combustor liner enclosing a combustion zone, according to the prior art.

It can be appreciated by one skilled in the relevant art that the outer liner 21 and the inner liner 23, shown in FIG. 1, may comprise outer liner downstream-pointed and upstream-pointed effusion holes and inner liner downstream-pointed and upstream-pointed effusion holes (not shown), respectively, for cooling purposes, similar to the effusion hole configuration of the liner dome 50. Accordingly, the above discussion, analysis, and design procedure is similarly applicable to the outer liner 21 and to the inner liner 23.

It should be understood, of course, that the foregoing relates to exemplary embodiments of the invention and that modifications may be made without departing from the spirit and scope of the invention as set forth in the following claims.

We claim:

1. A combustor liner suitable for use in a turbine engine, said combustor liner comprising:

a nonplanar inner liner;

a nonplanar outer liner; and a liner dome attached to said inner liner and to said outer liner so as to form an assembly enclosing a combustion zone, said liner dome having an exterior cool surface for intercepting a cooling air stream and an interior hot surface, said liner dome further having an array of effusion holes therethrough for passing cooling air from said cooling air stream into said combustion zone, wherein a local region of said array of effusion holes includes a plurality of upstream-pointed effusion holes, said upstream-pointed effusion holes having orientations obtuse to the direction of a main flow of gases in said combustion zone;

wherein said nonplanar inner liner comprises an array of inner liner effusion holes therethrough, a local region of said array of inner liner effusion holes in said inner liner including a plurality of upstream-pointed inner liner effusion holes oriented such that each said upstream-pointed inner liner effusion hole has an orientation obtuse to the direction of said main flow.

2. The combustor liner of claim 1 wherein said nonplanar outer liner comprises an array of outer liner effusion holes therethrough, a local region of said array of outer liner effusion holes in said outer liner including a plurality of upstream-pointed outer liner effusion holes oriented such that each said upstream-pointed outer liner effusion hole has an orientation obtuse to the direction of said main flow.

3. The combustor liner of claim 1 wherein said orientation obtuse to the direction of said main flow comprises a value in the range of 90° to 180°.

4. A combustor liner suitable for shielding an engine from heat generated in a combustion zone, said combustor liner comprising:

a liner dome having a cool surface for intercepting a cooling air stream and a hot surface partially enclosing the combustion zone, said liner dome further having an array of dome effusion holes therethrough, each of said dome effusion holes extending from said cool surface to said hot surface so as to allow a portion of said cooling air stream to pass through said plurality of dome effusion holes into the combustion zone, wherein a local region of said array of dome effusion holes includes a plurality of downstream-pointed dome effusion holes and a plurality of upstream-pointed dome effusion holes, said plurality of downstream-pointed dome effusion holes oriented such that each said downstream-pointed dome effusion hole has a longitudinal axis generally in the direction of a main flow in the combustion zone, and each said upstream-pointed dome effusion hole has a longitudinal axis forming an obtuse angle with the direction of said main flow such that cooling air entering the combustion zone through said upstream-pointed dome effusion holes reduces the momentum of cooling air entering the combustion zone through said downstream-pointed dome effusion holes;

a nonplanar inner liner partially enclosing the combustion zone and attached to said liner dome, said inner liner having a plurality of inner liner downstream-pointed effusion holes and a plurality of inner liner upstream-pointed effusion holes therethrough; and a nonplanar outer liner partially enclosing the combustion zone and attached to said liner dome, said outer liner having a plurality of outer liner downstream-pointed effusion holes and a plurality of outer liner upstream-pointed effusion holes therethrough.

5. The combustor liner of claim 4 wherein said obtuse angle comprises a value in the range of 150° to 180°.

6. The combustor liner of claim 4 wherein about one third of said dome effusion holes comprises said upstream-pointed dome effusion holes.

7. A method for controlling the momentum of effusion flow in a gas turbine engine combustion zone, said method comprising the steps of:

providing a combustor liner component having an array of effusion holes therein; and passing an airflow through said effusion holes to provide cooling of an interior hot surface of said combustor liner component, said array of effusion holes comprising a plurality of upstream-pointed effusion holes and a plurality of downstream-pointed effusion holes, wherein each said downstream-pointed effusion hole has a longitudinal axis generally aligned with a main flow direction in the combustion zone, and each said upstream-pointed effusion hole has a longitudinal axis generally oriented at an obtuse angle to the main flow direction.

8. The method of claim 7 wherein said obtuse orientation angle comprises a value in the range of 90° to 180°.

9. The method of claim 7 wherein about one third of said effusion holes comprise said upstream-pointed effusion holes.

10. The method of claim 7 wherein said array of effusion holes comprises a plurality of said effusion holes arranged in generally parallel rows.

11. The method of claim 10 wherein about one third of said generally parallel rows of said effusion holes comprises at least one of said upstream-pointed effusion holes.

12. A method for cooling a combustor liner component of a gas turbine engine, said method comprising the steps of: providing a cooling air stream against said combustor liner component, said combustor liner component having an array of effusion holes therein; and passing air from said cooling air stream through each of said effusion holes, wherein said array of effusion holes comprises a plurality of upstream-pointed effusion holes and a plurality of downstream-pointed effusion holes, wherein each said downstream-pointed effusion hole has a longitudinal axis generally aligned with a main flow direction in the gas turbine engine, and each said upstream-pointed effusion hole has a longitudinal axis generally oriented at an obtuse angle to the main flow direction.

13. A combustor liner suitable for use in a turbine engine, said combustor liner comprising:

a nonplanar inner liner;

a nonplanar outer liner; and a liner dome attached to said inner liner and to said outer liner so as to form an assembly enclosing a combustion zone, said liner dome having an exterior cool surface for intercepting a cooling air stream and an interior hot surface, said liner dome further having an array of effusion holes therethrough for passing cooling air from said cooling air stream into said combustion zone, wherein a local region of said array of effusion holes includes a plurality of upstream-pointed effusion holes, said upstream-pointed effusion holes having orientations obtuse to the direction of a main flow of gases in said combustion zone;

wherein said nonplanar outer liner comprises an array of outer liner effusion holes therethrough, a local region of said array of outer liner effusion holes in said outer liner including a plurality of upstream-pointed outer liner effusion holes oriented such that each said upstream-pointed outer liner effusion hole has an orientation obtuse to the direction of said main flow.

14. The combustor liner of claim 13 wherein said orientation obtuse to the direction of said main flow comprises a value in the range of 90° to 180°.

* * * * *